US007260911B2

(12) United States Patent
Davis

(10) Patent No.: US 7,260,911 B2
(45) Date of Patent: Aug. 28, 2007

(54) IN-LINE MUZZLE LOADER BORE SIGHT AND MAINTENANCE SYSTEM

(75) Inventor: Kelly J. Davis, Mead, WA (US)

(73) Assignee: Hunts, Inc., Mead, WA (US)

( * ) Notice: Subject to any disclaimer, the term of this patent is extended or adjusted under 35 U.S.C. 154(b) by 25 days.

(21) Appl. No.: 11/338,180

(22) Filed: Jan. 23, 2006

(65) Prior Publication Data

US 2007/0169392 A1 Jul. 26, 2007

(51) Int. Cl.
*F41G 1/38* (2006.01)

(52) U.S. Cl. ..... 42/121; 42/51; 42/116; 42/117

(58) Field of Classification Search ..... 42/121, 42/116, 117
See application file for complete search history.

(56) References Cited

U.S. PATENT DOCUMENTS

| | | | | |
|---|---|---|---|---|
| 1,645,881 | A | 10/1927 | Strong | |
| 2,548,871 | A * | 4/1951 | Cranmer | 89/200 |
| 3,471,945 | A | 10/1969 | Fleury | |
| 3,782,832 | A | 1/1974 | Hacskaylo | |
| 4,481,561 | A | 11/1984 | Lanning | |
| 4,530,162 | A | 7/1985 | Forrest et al. | |
| 4,761,907 | A | 8/1988 | DeBernardini | |
| 4,825,258 | A | 4/1989 | Whitson | |
| 4,830,617 | A | 5/1989 | Hancox et al. | |
| 4,879,814 | A | 11/1989 | Wallace et al. | |
| 5,001,836 | A | 3/1991 | Cameron et al. | |
| 5,241,458 | A | 8/1993 | Abbas | |
| 5,351,429 | A | 10/1994 | Ford | |
| 5,365,669 | A | 11/1994 | Rustick et al. | |
| 5,432,598 | A | 7/1995 | Szatkowski | |
| 5,446,535 | A | 8/1995 | Williams | |
| 5,454,168 | A | 10/1995 | Langner | |
| 5,488,795 | A | 2/1996 | Sweat | |
| 5,531,040 | A | 7/1996 | Moore | |
| 5,685,106 | A | 11/1997 | Shoham | |
| 5,787,631 | A | 8/1998 | Kendall | |
| 5,909,951 | A | 6/1999 | Johnsen et al. | |
| 6,061,918 | A | 5/2000 | Schnell | |
| 6,068,484 | A | 5/2000 | O'Loughlin et al. | |
| 6,151,788 | A | 11/2000 | Cox et al. | |
| 6,216,381 | B1 | 4/2001 | Strand | |
| 6,289,624 | B1 * | 9/2001 | Hughes et al. | 42/116 |
| 6,389,730 | B1 | 5/2002 | Millard | |

FOREIGN PATENT DOCUMENTS

| | | |
|---|---|---|
| CA | 2187159 | 8/1996 |
| CA | 2217791 | 6/1999 |
| CA | 2308688 | 11/2000 |
| EP | 0 773 422 A1 | 5/1997 |

* cited by examiner

*Primary Examiner*—Michael J. Carone
*Assistant Examiner*—Gabriel J. Klein
(74) *Attorney, Agent, or Firm*—Wells St. John, P.S.

(57) ABSTRACT

A firearm bore sighting system is described for in-line muzzle loaders which include a breach plug, the bore sighting system rotating into the breach plug threads and which may include a stop to locate the bore sighting system relative to the breach.

8 Claims, 8 Drawing Sheets

230
231
232
233
234
235
236
237

IN-LINE MUZZLE LOADER BORE SIGHT AND MAINTENANCE SYSTEM

TECHNICAL FIELD

The present invention relates to bore sight system particularly adapted for use in sighting muzzle loader firearms.

BACKGROUND OF THE INVENTION

The prior processes involved for "sighting in" a firearm typically involve the use of a target and live ammunition. While this process is typically satisfactory for the shooter, a considerable amount of time and a degree of expense are involved.

The above "sighting in" process may not be available in certain situations. For example, a hunter may jar the firearm and upset the previous sight adjustments. The hunter may be in a situation where the typical process for "sighting in" the weapon is not possible or advisable. This is especially true in situations where the discharge of the firearm could have a negative effect on hunting situations. Further, access to a proper target range is not always easily available. A need has therefore been realized for some form of sighting device that does not require discharge of live ammunition to at least initially accurately set the targeting sights of the firearm.

In response to the above need, various forms of "bore" sighting devices have been developed. In the distant past, such sighting devices made use of incandescent-type lights. More recent developments, however, have lead to the use of laser sighting arrangements. Of these, numerous units are adapted for insertion at the muzzle end of the firearm. The use of a laser certainly increases the potential for accuracy. However, the mounting of a laser in the muzzle end of a firearm does not necessarily lead to an accurate representation of the path a bullet will travel to a selected spot on a target. A very slight misalignment of the laser beam from this point will result in huge magnification of the error at even relatively short distances.

Others have sought the solution of mounting a laser optical device within the firing chamber of a firearm. One such device is described in U.S. Pat. No. 5,787,631 to Kendall. Another such device is described in U.S. Pat. No. 6,631,580 issued to Davis et. al., which is incorporated herein by this reference.

A need has remained for a firearm bore sight system that will maintain an accurate coaxial relationship with a firearm cartridge-shaped insert so that a light beam will be maintained in a coaxial relationship with a muzzle loader type of firearm bore so a reliable and repeatable identification can be easily and quickly determined. A dot of light, then, at a distance of, say, twenty-five to thirty yards, will reliably indicate that point as being along the axis of the firearm bore. This point can then be used to accurately gage and calibrate the external sighting device for the weapon.

In-line muzzle loader firearms and the configuration thereof present a unique problem in the use of such laser sighting cartridges due to the less than desirable chamber to hold and accurately locate a laser cartridge, and difficulty in placing a bore sight into the same location of the breach each time.

An object of the present invention is to provide a laser based in-line muzzle loader firearm bore sighting system for sighting a muzzle loader with internal threads in the breach.

BRIEF DESCRIPTION OF THE DRAWINGS

Preferred embodiments of the invention are described below with reference to the following accompanying drawings:

FIG. 9 is part cross-sectional view of one embodiment of a laser bore sighting system which may be utilized in practicing this invention

FIG. 13 is an exploded elevation view of another example of an embodiment of this invention, which may be used in a long action type of muzzle loader; and FIG. 14 is an elevation view of the embodiment of this invention shown in FIG. 13.

DESCRIPTION OF THE PREFERRED EMBODIMENT

It should be noted that certain of the fasteners, materials, power sources, mechanisms, control circuitry, manufacturing and other means and components utilized to make and implement this invention are known and used in the field of the invention described, and their exact nature or type is not necessary for an understanding and use of the invention by a person skilled in the art or science. As such, specific details of such means and components will not be discussed in great detail herein.

Furthermore, the various components shown or described herein for any specific application of this invention can be varied or altered as anticipated by this invention and the practice of a specific application or embodiment of any element may already be widely known or used in the art or by persons skilled in the art or science.

The terms "a", "an", and "the" as used in the claims and elsewhere herein are used in conformance with long-standing claim drafting practice and not in a limiting way. Unless specifically set forth herein, the terms "a", "an", and "the" are not limited to one of such elements, but instead mean "at least one".

Until this invention applicant is unaware of any laser sighting device which may be placed within the breach of an in-line muzzle loader firearm. There is generally a lack of consistent or accurate reference points to result in accurate or consistent placement of such a laser bore sighting system in the breach. This invention however provides a solution for this long-felt need by providing a laser bore sight which screws into the internal threads utilized for the breach plug and by providing a reference system to assure it is rotated or screwed consistently into the same location. In the preferred embodiment, thread stops are utilized to provide that reference point, but it will be appreciated that other referenced or fixing points may also be utilized to stop the rotation of the bore sight system into the breach at a location or reference point which is acceptably consistent.

Rifle bores have an internal pattern or configuration which impart a rotation on the projectile being shot. These patterns may include what are generally referred to as grooves and lands, and they may be configured in a spiral or other pattern within the barrel. A groove generally refers to the lower portion and the "lands" refer to the raised portion of the pattern.

Figure 1:
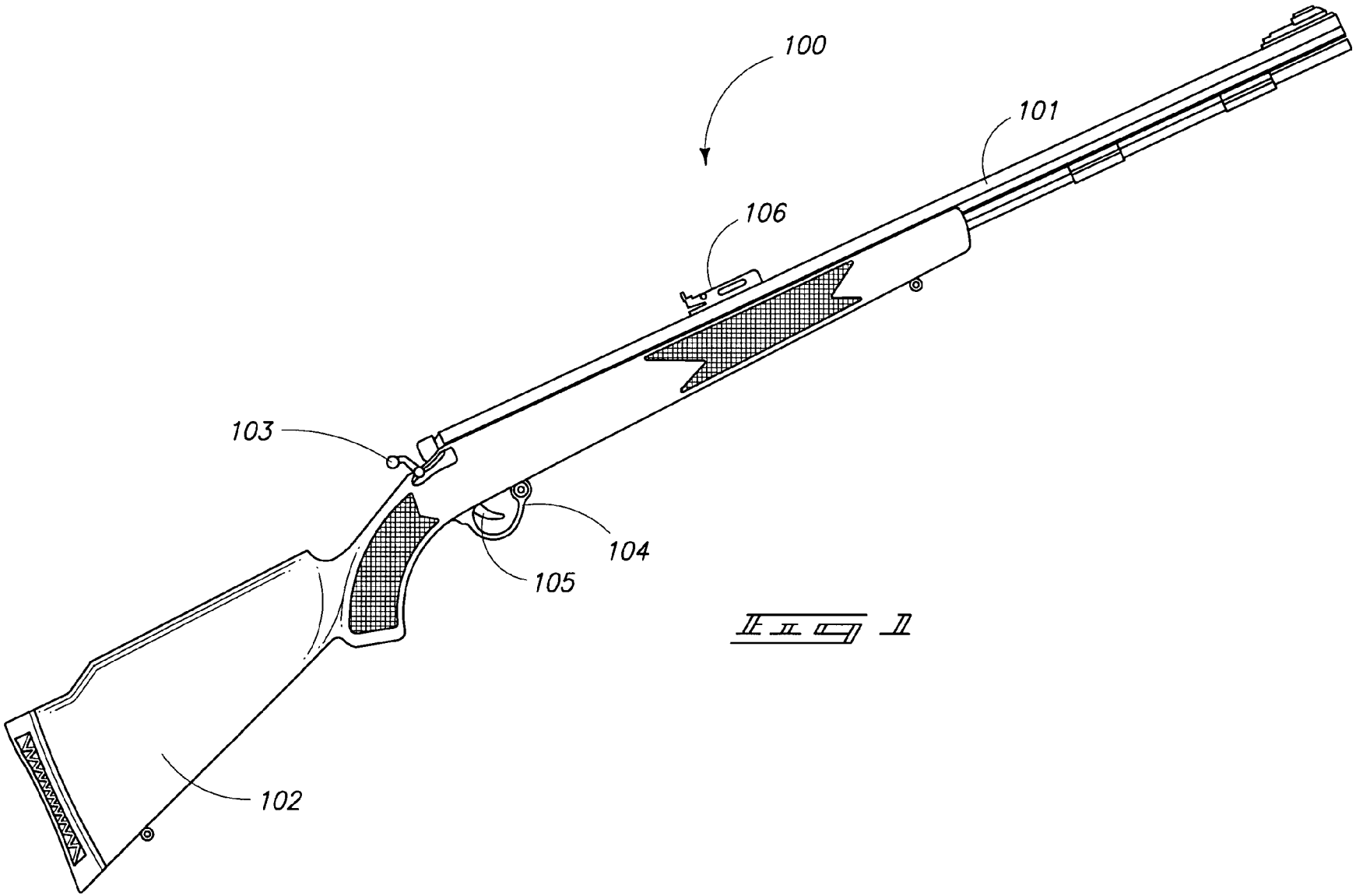
FIG. 1 is a perspective view of one example of a typical in-line muzzle loader rifle.

FIG. 1 is a perspective view of one example of a typical in-line muzzle loader rifle 100, illustrating stock 102, barrel 101, rear sight 106, trigger 105, hammer 103, and trigger guard 104. Muzzle loaders of various types, shapes and configurations are well known in the art and will not be described in further detail. It will be appreciated by those of ordinary skill in the art that although one type of in-line muzzle loader rifle is shown, this invention is not limited to only one such design, but instead may be utilized or applied in several different such designs, with no one in particular being required to practice the invention. For instance, there are short action type muzzle loaders, which also may be referred to as a break action or rolling block style of muzzle loader. This invention may by applied in different embodiments of varying length and varying thread patterns, which enable the user to screw the unit directly into the breach plug area of the muzzle loader. By way of further example, but not to limit the scope of embodiments to which this invention may be applied, there are also long action muzzle loaders, which may also be referred to as the bolt or hammer style of muzzle loader, to which this invention may also be applied.

Figure 2:
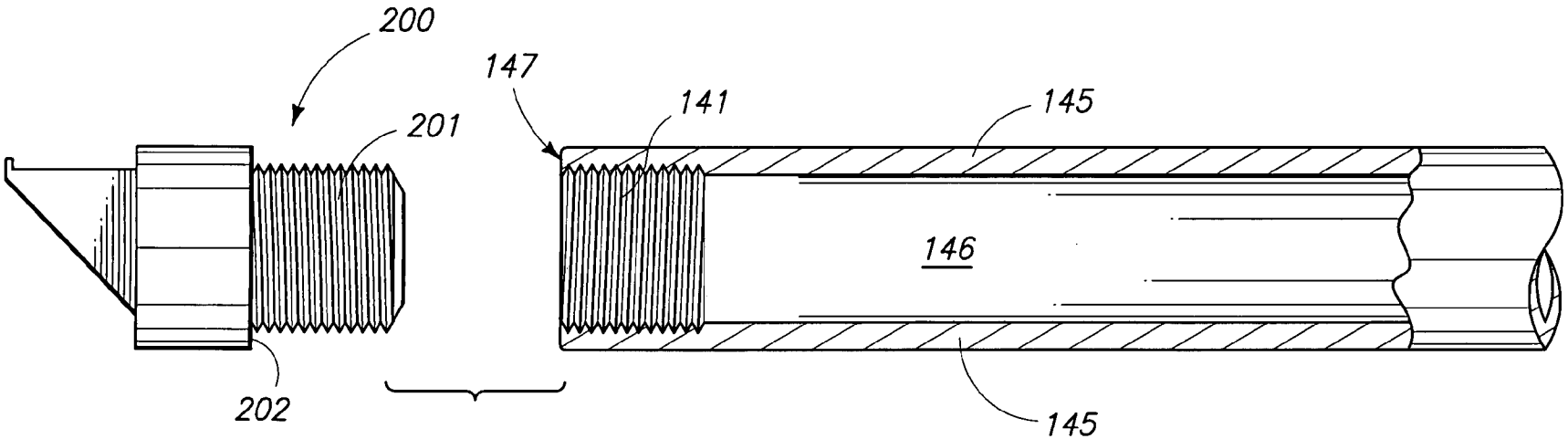
FIG. 2 is a part cross-sectional view of one example of an in-line muzzle loader with a threaded breach plug.

FIG. 2 is a part cross-sectional view of one example of an in-line muzzle loader with a threaded breach plug 200. FIG. 2 shows breach plug 200 with external threads 201 for rotating or screwing into the breach 140 of the barrel 145 of the in-line muzzle loader (as partially shown). The breach includes internal threads 141 which correspond and matingly engage the external threads 201 on the breach plug 200.

It will be appreciated by those of ordinary skill in the art that there are a wide variety of different thread types utilized on different makes and models of in-line muzzle loaders and this invention is not directed to any one in particular. The bore sight systems contemplated by this invention may be sized or configured to correspond to and matingly engage any one of a number of different configurations.

Figure 3:
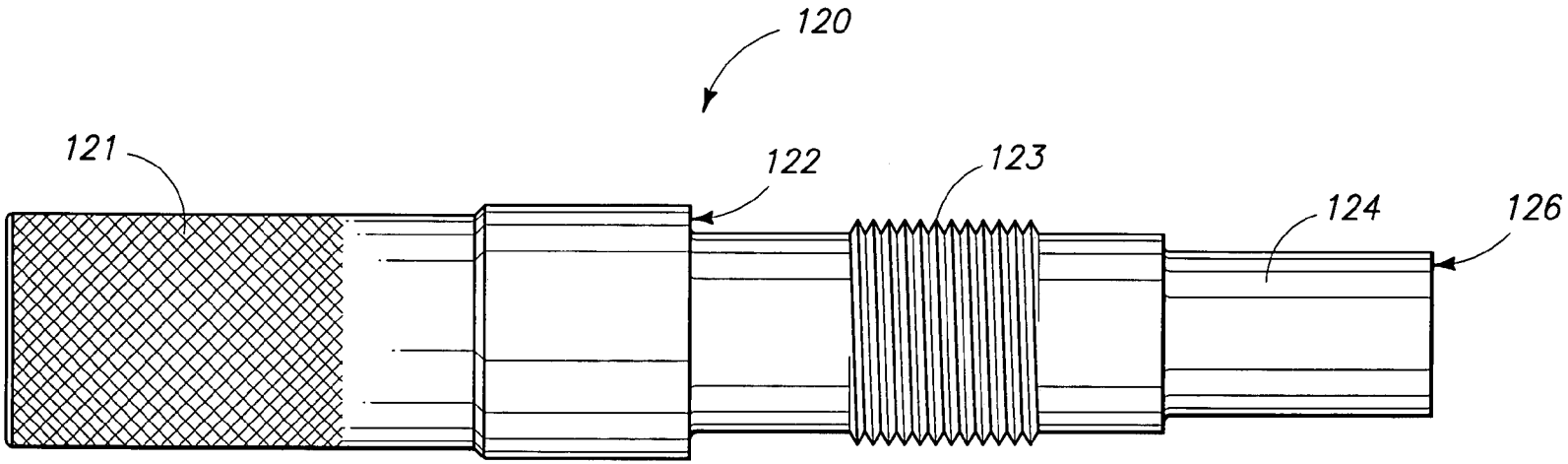
FIG. 3 is an elevation view of one embodiment of a sighting system which may be utilized in practicing this invention.

FIG. 3 is an elevation view of one embodiment of a bore sight body 120 which may be utilized in practicing this invention, illustrating handle 121 shoulder 122 (which may be utilized as a stop), external threads 123 and forward bore sight body portion 124. The end or shoulder 126 on bore sight body portion 124 may also be utilized as a positioning stop relative to; landings within the weapon (landings are shown and described more fully in the discussion below relative to FIG. 8).

Figure 4:
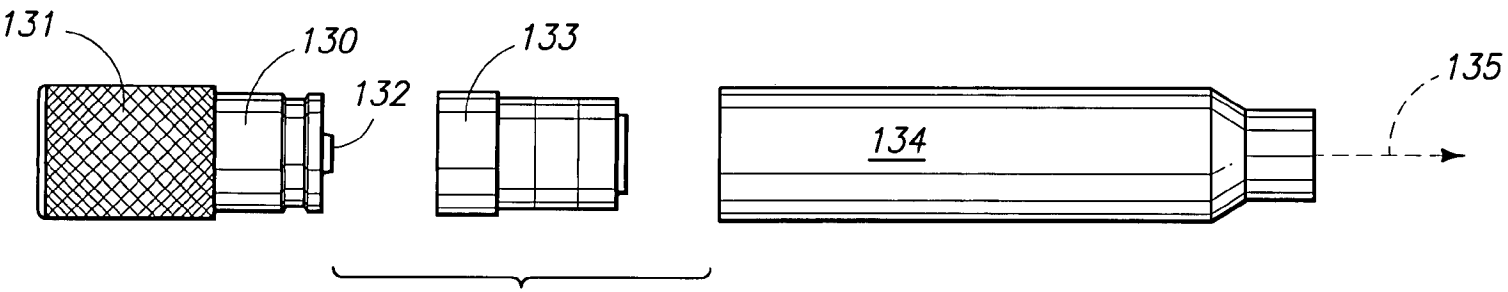
FIG. 4 is an exploded elevation view of one embodiment of a cartridge insert which may be utilized which may be utilized in a sighting system contemplated by this invention.

FIG. 4 is an exploded elevation view of one embodiment of a laser cartridge insert which may be utilized which may be utilized in a sighting system contemplated by this invention, illustrating cartridge body 134, batter pack 133, handle 131, emitted optical beam 135, and handle body. As is shown in FIG. 5, the cartridge configuration shown in FIG. 4 is then inserted into a cartridge cavity in a bore sight body for placement into the breach of an in-line muzzle loader.

Figure 5:
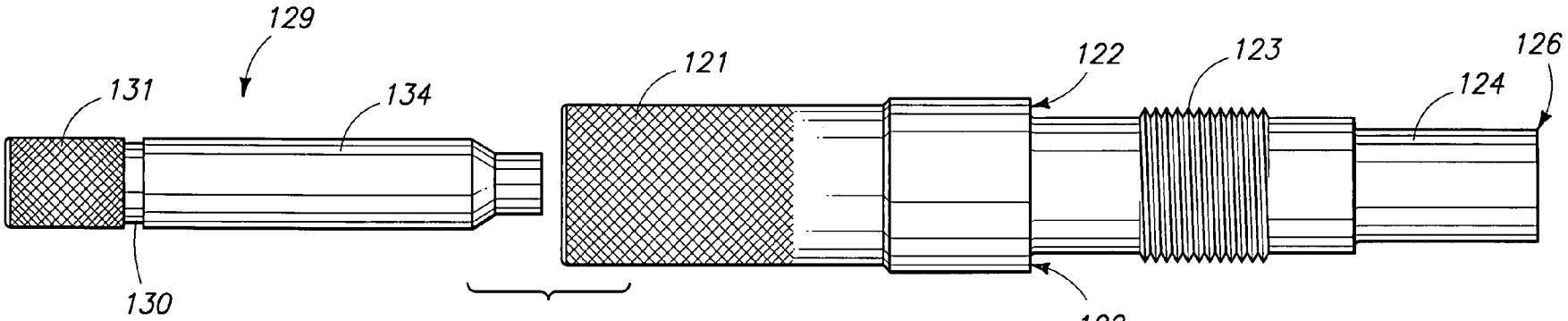
FIG. 5 is an exploded elevation view of the cartridge insert illustrated in FIG. 3 relative to the embodiment of the sighting system shown in FIG. 2.

FIG. 5 is an exploded elevation view of the cartridge insert illustrated in FIG. 3 relative to the embodiment of the sighting system shown in FIG. 2. FIG. 5 illustrates bore sight body 120 which may be utilized in practicing this invention, illustrating handle 121, shoulder 122 (which may be utilized as a stop), external threads 123 and forward bore sight body portion 124. As stated above, the end or shoulder 126 on bore sight body portion 124 may also be utilized as a positioning stop relative to landings within the weapon (landings are shown and described more fully in the discussion below relative to FIG. 8).

Figure 6:
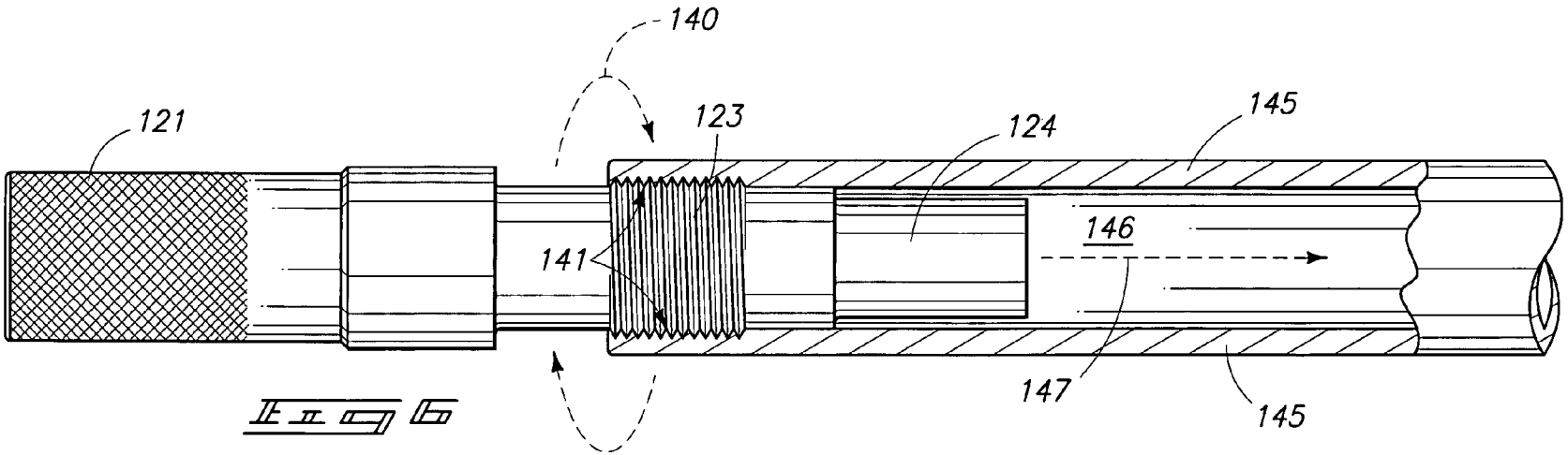
FIG. 6 is a part cross-sectional elevation view of one embodiment of a sighting system in the breach of the weapon.

FIG. 6 is a part cross-sectional elevation view of one embodiment of a sighting system which may be utilized in practicing this invention, rotatably inserted within a muzzle loader breach 146. FIG. 6 illustrates handle 121 which may be used to rotate or screw the bore sight body (as indicated by arrow 140) into the breach 146 of the weapon. FIG. 6 shows external threads 123 on the laser bore sight body, muzzle loader body 145, emitted optical beam 147 and the internal threads 141 in the breach 146 of the weapon.

Figure 7:
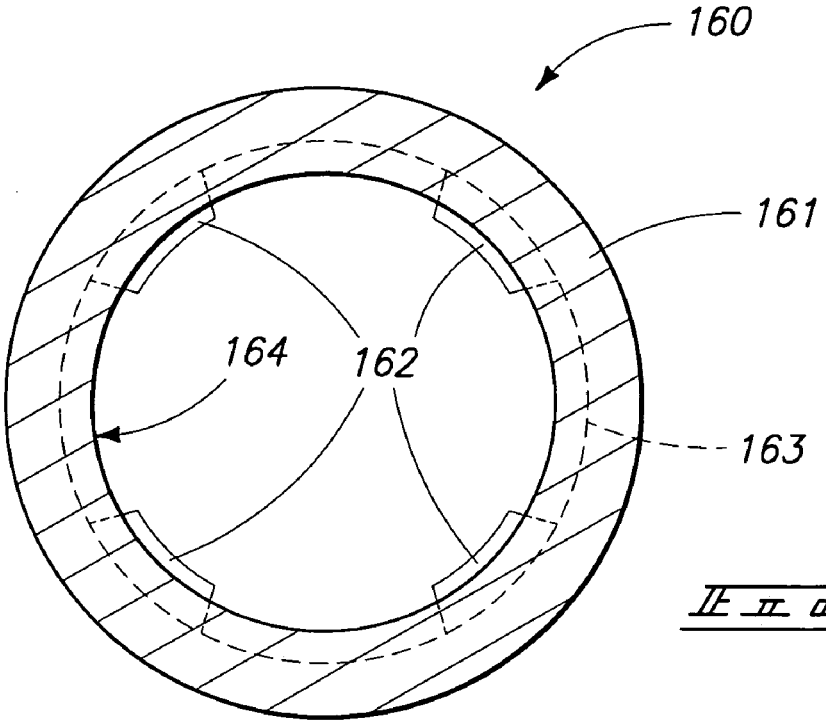
FIG. 7 is a cross-sectional view showing landings within a breach of an in-line muzzle loader weapon.

FIG. 7 is a cross-sectional view showing landings 162 within a breach of a muzzle loader weapon, inner surface 164, with grooves 163 being between landings 162. The landings 162 within the weapon may, in some embodiments of the invention, be the stops and/or reference points for preventing the bore sight body from further rotating into the weapon, all within the contemplation of this invention.

Figure 8:
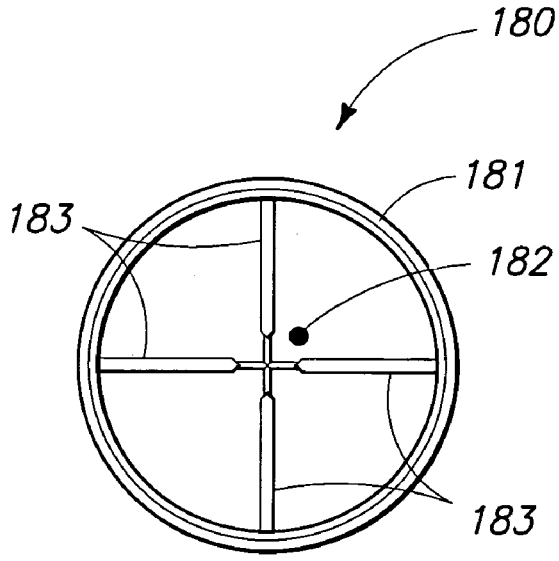
FIG. 8 is an elevation view of one embodiment of a sighting system which may be utilized in connection with this invention.

FIG. 8 is a view through the cross-hairs of a sight 180, and may for instance represent when the weapon or sight is at "zero", which would be sighted in. FIG. 8 shows cross-hairs 183 within sight framework 181, and laser dot 182 projected relative to the cross-hairs 183. The user would always sight the weapon in at the same distance, twenty to thirty yards for example, and then whatever the location of the projected laser dot 182 is the zero point. So for instance if the weapon gets dropped or jammed, the sight can then be targeted from the same distance from which zero was established and thereby accurately reposition the sight relative to the dot. The same process can be followed for other types and configurations of sights.

FIG. 9 is part cross-sectional view of one embodiment of a sighting system which may be utilized in practicing this invention. FIG. 9 illustrates bore sight body 120, cartridge 134 within bore sight body 120, handle 131, handle body 139, batteries 221, external threads 123 in bore sight body 120, and shoulder 122 (which may act as a stop) and end or shoulder 126 (which may act as a stop). FIG. 9 further shows emitted optical beam 223 (preferably a laser beam) emitted or projected through breach 220.

Figures 10, 11, 12:
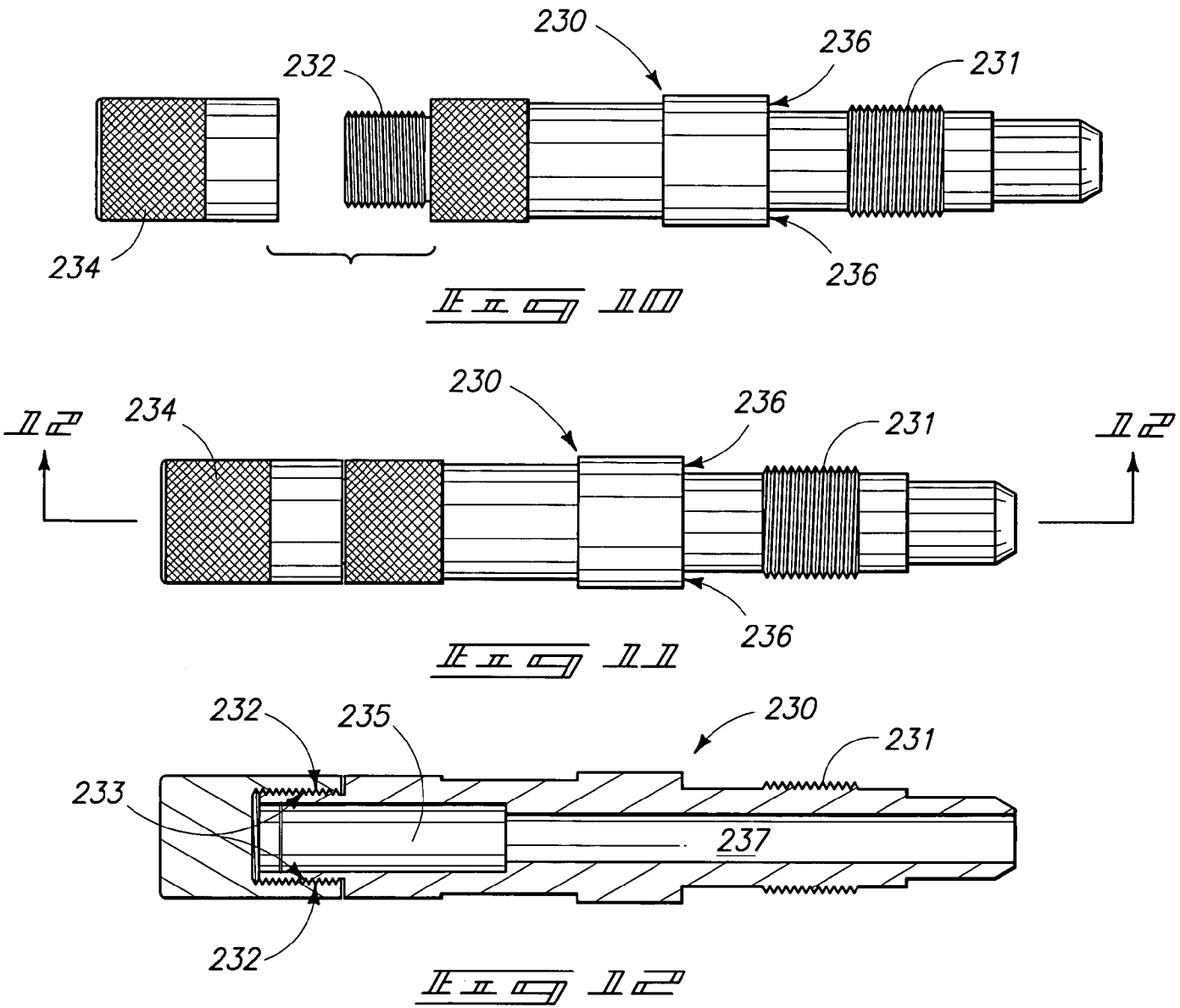
FIG. 10 is an exploded elevation view of another example of an embodiment of this invention, which may be utilized in a short action type of muzzle loader.
FIG. 12 is a view of section 12-12 from FIG. 11.
Figure 11:
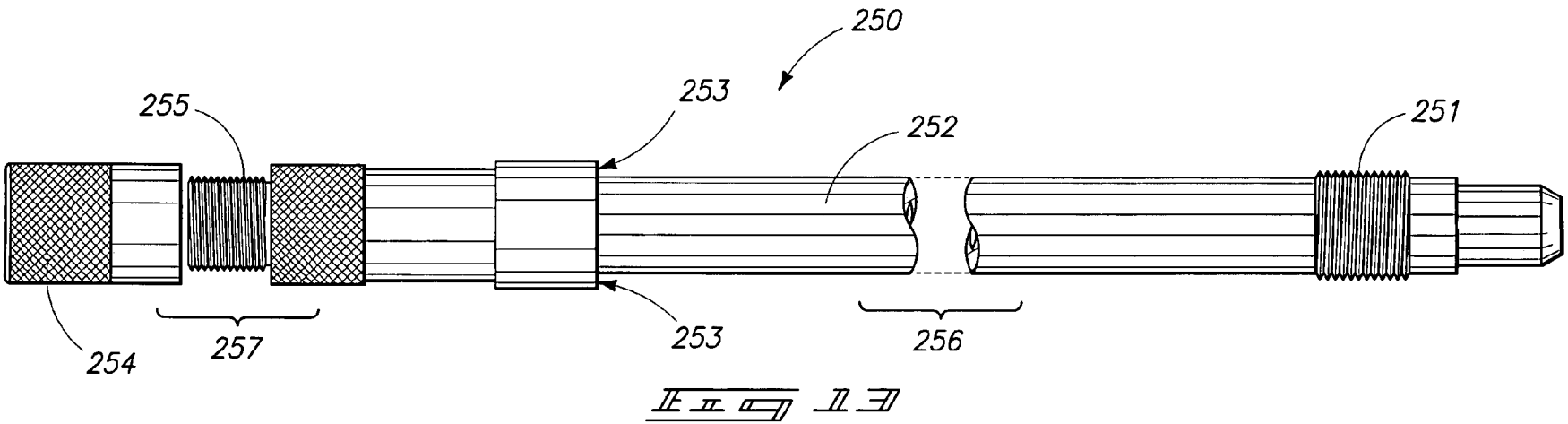
Figure 12:
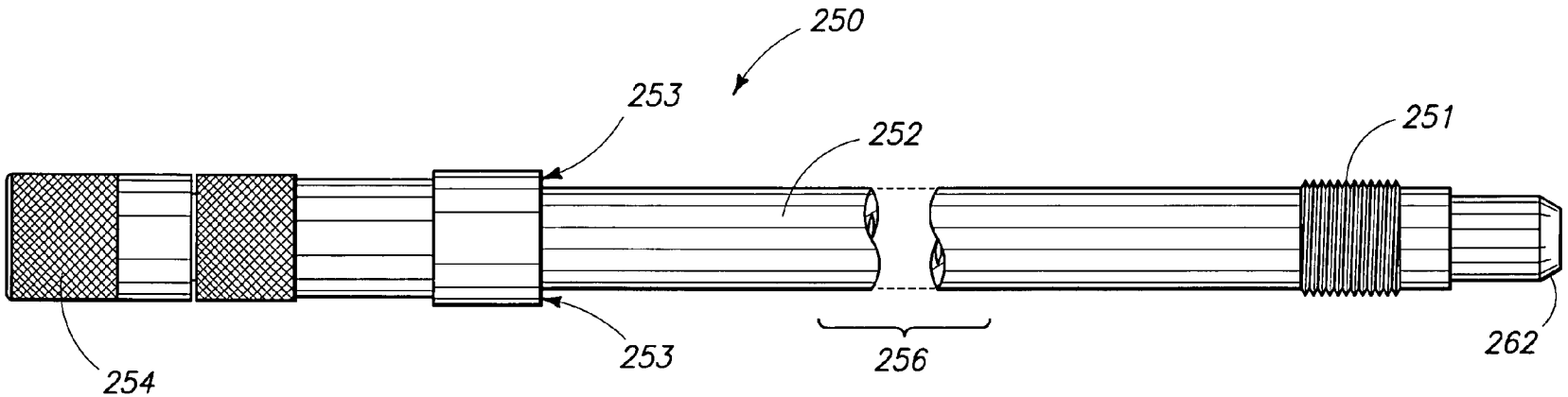

FIG. 10 is an exploded elevation view of another example of an embodiment of this invention, which may be utilized in a short action type of muzzle loader. FIG. 10 illustrates bore sight body 230, handle 234, threads 232 on bore sight body 230 for screwing handle 234 on. Shoulder 236, or stop 236, is positioned to provide a consistent point of reference to establish a sight when threads 231 are screwed into the muzzle loader.

Figure 11:
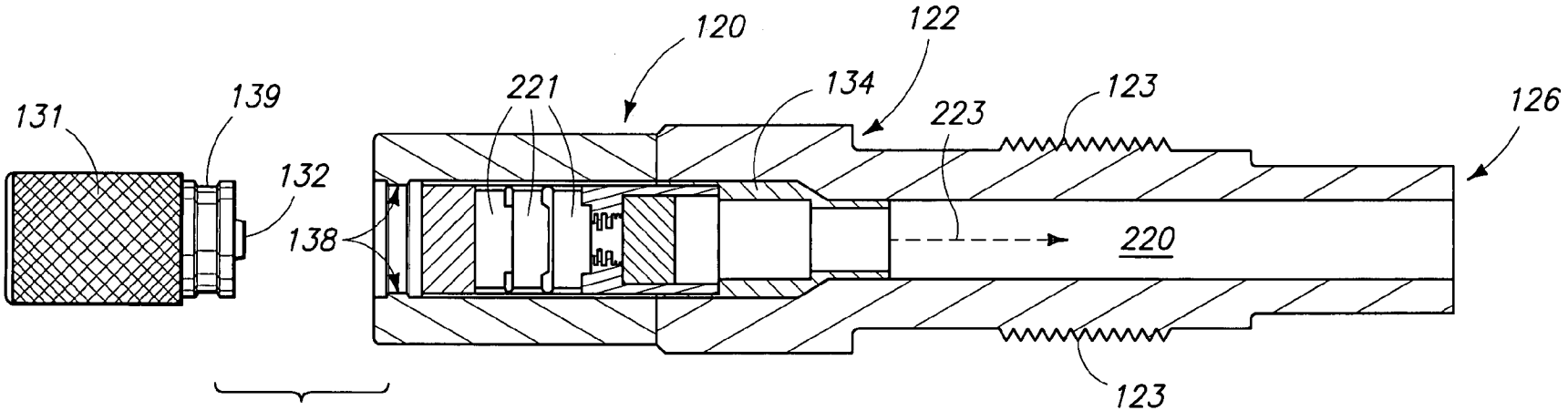
FIG. 11 is an elevation view of the embodiment of this invention shown in FIG. 10.

FIG. 11 is an elevation view of the embodiment of this invention shown in FIG. 10, only with the handle 234 screwed on. FIG. 11 shows the same components and item numbers as FIG. 10 and a description of each will therefore not be set forth here.

FIG. 12 is a view of section 12-12 from FIG. 11, and illustrates bore sight body 230, external threads 232 on bore sight body 230 for screwing handle 234 on, internal threads 233 in handle and breach 237.

FIG. 13 is an exploded elevation view of another example of an embodiment of this invention, which may be used in a long action type of muzzle loader. FIG. 13 illustrates bore sight body 250, handle 254, threads 255 on bore sight body 250 for screwing handle 254 on. Shoulder 253, or stop 253, is positioned to provide a consistent point of reference to establish a sight when threads 255 are screwed into the muzzle loader. Item 256 illustrates how the bore sight body shown has an elongated body section 252 beyond the size that can be best shown in FIG. 13, as it is configured for application into a long action type of muzzle loader, by screws 251 screwing into internal threads within the breach of the muzzle loader.

FIG. 14 is an elevation view of the embodiment of this invention shown in FIG. 13, only with the handle 254 screwed on. FIG. 14 shows the same components and item numbers as FIG. 13 and a description of each will therefore not be set forth here. FIG. 14 also shows a stop 262 area which may be used in embodiments of this invention, such that when the bore sight body 250 is screwed or rotated into the breach of the muzzle loader, stop 262 will preferably abut the landings in the muzzle loader to provide a consistent location for sighting and for accuracy maintenance.

As will be appreciated by those of reasonable skill in the art, there are numerous embodiments to this invention, and variations of elements and components which may be used, all within the scope of this invention.

One embodiment of this invention, for example, is an in-line muzzle loader bore sighting system comprising the following steps: providing a laser bore sight comprising: a bore sight body with external threads on the bore sight body, an optical beam emitting device within the bore sight body and wherein the external threads on the bore sight body are configured to thread into a pre-determined thread pattern corresponding to internal threads for a breach plug in a breach of a muzzle loader; rotating the external threads on the laser bore sight into the internal breach plug threads; and utilizing the laser bore sight to sight in the in-line muzzle loader. This embodiment may but need not include providing the laser bore sight with a stop, configured to stop the rotation of the laser bore sight into the internal threads in the breach of the muzzle loader; further rotating the external threads on the laser bore sight into the internal breach plug threads until the stop prevents further rotation; and utilizing the laser bore sight to sight in the in-line muzzle loader.

The stop may for example but not by way of limitation, be a shoulder on the bore sight body configured to abut the muzzle loader and thereby stop the rotation of the laser bore sight into the internal breach plug threads; or it may be an end on the bore sight body configured to abut lands within the muzzle loader, and thereby stop the rotation of the laser bore sight into the internal breach plug threads.

In yet another embodiment of the invention, an in-line muzzle loader bore sighting system is provided which comprises the following: a laser bore sight comprising: a bore sight body comprising: external threads on the bore sight body, the external threads configured to thread into a pre-determined thread pattern corresponding to internal threads for a breach plug in a breach of a muzzle loader; and an optical beam emitting device within the bore sight body. This embodiment may but need not further comprise a stop configured to engage the muzzle loader to stop the rotation of the laser bore sight into the internal threads in the breach of the muzzle loader at a pre-determined location; wherein the stop may, without limitation, for instance be an end of the bore sight body configured to abut landings in the muzzle loader to stop the rotation of the laser bore sight into the internal threads in the breach of the muzzle loader at a pre-determined point.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. An in-line muzzle loader bore sighting system comprising the following steps:

providing a laser bore sight comprising:

a bore sight body with external threads on the bore sight body, an optical beam emitting device within the bore sight body and wherein the external threads on the bore sight body are configured to thread into a pre-determined thread pattern corresponding to internal threads for a breach plug in a breach of a muzzle loader;

rotating the external threads on the laser bore sight into the internal breach plug threads; and utilizing the laser bore sight to sight in the in-line muzzle loader.

2. An in-line muzzle loader bore sighting system as recited in claim 1, and further:

providing the laser bore sight with a stop, configured to stop the rotation of the laser bore sight into the internal threads in the breach of the muzzle loader;

further rotating the external threads on the laser bore sight into the internal breach plug threads until the stop prevents further rotation; and utilizing the laser bore sight to sight in the in-line muzzle loader.

3. An in-line muzzle loader bore sighting system as recited in claim 2, and further wherein the stop is a shoulder on the bore sight body configured to abut the muzzle loader and thereby stop the rotation of the laser bore sight into the internal breach plug threads.

4. An in-line muzzle loader bore sighting system as recited in claim 2, and further wherein the stop is an end on the bore sight body configured to abut lands within the muzzle loader, and thereby stop the rotation of the laser bore sight into the internal breach plug threads.

5. An in-line muzzle loader bore sighting system comprising the following:

a laser bore sight comprising:

a bore sight body comprising:

external threads on the bore sight body, the external threads threaded into a breach plug receiving space of a muzzle loader; and an optical beam emitting device within the bore sight body.

6. An in-line muzzle loader bore sighting system as recited in claim 5, and further comprising a stop configured to engage the muzzle loader to stop the rotation of the laser bore sight into the internal threads in the breach of the muzzle loader at a pre-determined location.

7. An in-line muzzle loader bore sighting system as recited in claim 6, and further wherein the stop is configured to abut landings in the muzzle loader to stop the rotation of the laser bore sight into the internal threads in the breach of the muzzle loader at a pre-determined point.

8. An in-line muzzle loader bore sighting system as recited in claim 6, and further wherein the stop is a shoulder on the bore sight body configured to abut the muzzle loader and thereby stop the rotation of the laser bore sight into the internal breach plug threads.

* * * * *